United States Patent [19]

Fritsch

[11] Patent Number: 5,076,085

[45] Date of Patent: Dec. 31, 1991

[54] APPARATUS FOR FORMING A METALLIC UNIT HAVING A CONCAVE PORTION BOUNDED BY A PERIPHERAL EDGE

[76] Inventor: Rudy Fritsch, 7395 David laurent, Riviere des Prairie, Quebec, Canada H1E 3L5

[21] Appl. No.: 637,198

[22] Filed: Jan. 3, 1991

[51] Int. Cl.[5] ..... B21D 26/02

[52] U.S. Cl. ..... 72/60; 29/421.1

[58] Field of Search ..... 72/56, 58, 60, 63; 29/421.1

[56] References Cited

U.S. PATENT DOCUMENTS

| | | | |
|---|---|---|---|
| 3,739,617 | 6/1973 | Stejskal | 72/63 |
| 3,914,969 | 10/1975 | Banks | 72/63 |
| 3,934,441 | 1/1976 | Hamilton et al. | 72/60 |
| 4,354,369 | 10/1982 | Hamilton | 72/60 |
| 4,409,808 | 10/1983 | Festag et al. | 72/60 |
| 4,409,809 | 10/1983 | Buchanan | 72/60 |
| 4,512,171 | 4/1985 | Mozley | 72/60 |
| 4,516,419 | 5/1985 | Agrawal | 72/60 |
| 4,951,491 | 8/1990 | Lorenz | 72/60 |

FOREIGN PATENT DOCUMENTS

| | | | |
|---|---|---|---|
| 1914035 | 10/1969 | Fed. Rep. of Germany | 72/60 |
| 0831270 | 5/1981 | U.S.S.R. | 72/60 |

*Primary Examiner*—David Jones

*Attorney, Agent, or Firm*—Fishman, Dionne & Cantor

[57] ABSTRACT

Each of the metallic units has a concave portion bounded by a peripheral edge which has a predetermined shape. The apparatus includes an upper member and a lower member and a tool is adapted to be mounted on the upper or lower member. The tool comprises a wall-like structure having a bottom edge which defines a shape corresponding with the predetermined shape. The upper member and lower member are arranged to be movable relative one to the other, and a workpiece is placed between the two members and the members are brought together until the tool is clamped abuts the workpiece so that the tool and workpiece are clamped together in airtight engagement. Air under pressure is applied under the workpiece to form the workpiece into a concave shape.

5 Claims, 3 Drawing Sheets

APPARATUS FOR FORMING A METALLIC UNIT HAVING A CONCAVE PORTION BOUNDED BY A PERIPHERAL EDGE

BACKGROUND OF INVENTION

1. Field of the Invention

The invention relates to an apparatus for forming, from a metallic workpiece, a metallic unit having a concave portion bounded by a peripheral edge having a predetermined shape. More specifically, the invention relates to such an apparatus which is adapted to mount a tool comprising a wall-like structure having a bottom edge which defines a shape, the shape corresponding with the predetermined shape.

2. Description of Prior Art

Apparatus for forming metallic units are known in the art as illustrated in, for example, U.S. Pat. No. 3,934,441, Hamilton et al, Jan. 27, 1976, U.S. Pat. No. 4,516,419, Agrawal, May 14, 1985 and U.S. Pat. No. 4,409,809, Buchanan, Oct. 18, 1983.

The Hamilton et al patent teaches an apparatus which uses a fluid, e.g. air, under pressure to form a metallic part. However, in the Hamilton et al patent, the part is formed in a die 18 which is in the desired shape of the part. The Agrawal patent teaches a similar arrangement wherein the workpiece 18 is formed into the shape of the cavity 24 of the die 22.

In the Buchanan patent, an upper platen 1 has a downwardly extending peripheral wall 2 to define a first chamber 3. A lower platen 6 includes upwardly extending annular wall 10 which, together with platen 6, defines a chamber 13. The lower platen 6 is carried on rams 7 which move the lower platen 6 towards the upper platen 1.

A male mold 20 is secured on a table 18 which is carried on rams 16 of hydraulic motor 17. In operation, hydraulic motors 8 are started to move the ram 7 upwardly so that platen 6 is moved towards platen 1. A workpiece 21 is clamped between plates 4 and 11, and air under pressure is allowed into chamber 13 to force the workpiece 21 into the shape shown in FIG. 2.

Buchanan then goes on to form the workpiece 21 into the shape of the mold or die 20, as shown in FIGS. 3 and 4. However, it is noted that Buchanan uses a die but does not use a tool for the forming of the metallic units. Further, the two above-discussed references also use dies but not tools for forming metallic units.

SUMMARY OF INVENTION

It is therefore an object of the invention to provide an apparatus for forming a metallic unit which has a concave portion wherein the apparatus is adapted to mount a tool for the forming process.

It is a more specific object of the invention to provide such an apparatus wherein the tool comprises a wall-like structure.

In accordance with the general principles of the invention, there is provided an apparatus for forming, from a metallic workpiece, a metallic unit having a concave portion bounded by a peripheral edge having a predetermined shape, wherein the apparatus is adapted to mount a tool comprising a wall-like structure having a bottom edge which defines a shape, the shape corresponding with the predetermined shape.

In accordance with the invention there is provided an apparatus for forming, from a metallic workpiece, a metallic unit having a concave portion bounded by a peripheral edge, said peripheral edge having a predetermined shape;

said apparatus comprising:

an upper member and a lower member;

means for moving one of said upper or lower members relative to the other one of said upper or lower members to thereby move said upper and lower members toward or away from each other;

means for removably mounting a tool on one of said upper or lower members, the other one of said upper or lower members having an opening therein;

means for providing fluid under pressure, said means for providing having output means; and communication means connecting said output means to said opening;

wherein, said tool comprises a wall-like arrangement having a bottom edge defining a shape, said shape of said bottom edge corresponding with said predetermined shape;

whereby, in operation, said workpiece, having an outer peripheral edge, is disposed between said upper and lower member such that said outer peripheral edge surrounds said bottom edge, said upper and lower members are moved towards each other until said bottom edge abuts a surface of said workpiece so that the tool and workpiece are clamped together in airtight engagement, and said fluid under pressure is applied to said opening under the other surface of said workpiece to thereby form said concave portion.

BRIEF DESCRIPTION OF DRAWINGS

The invention will be better understood by an examination of the following description, together with the accompanying drawings, in which.

DESCRIPTION OF PREFERRED EMBODIMENTS

Figures 1, 2, 3:
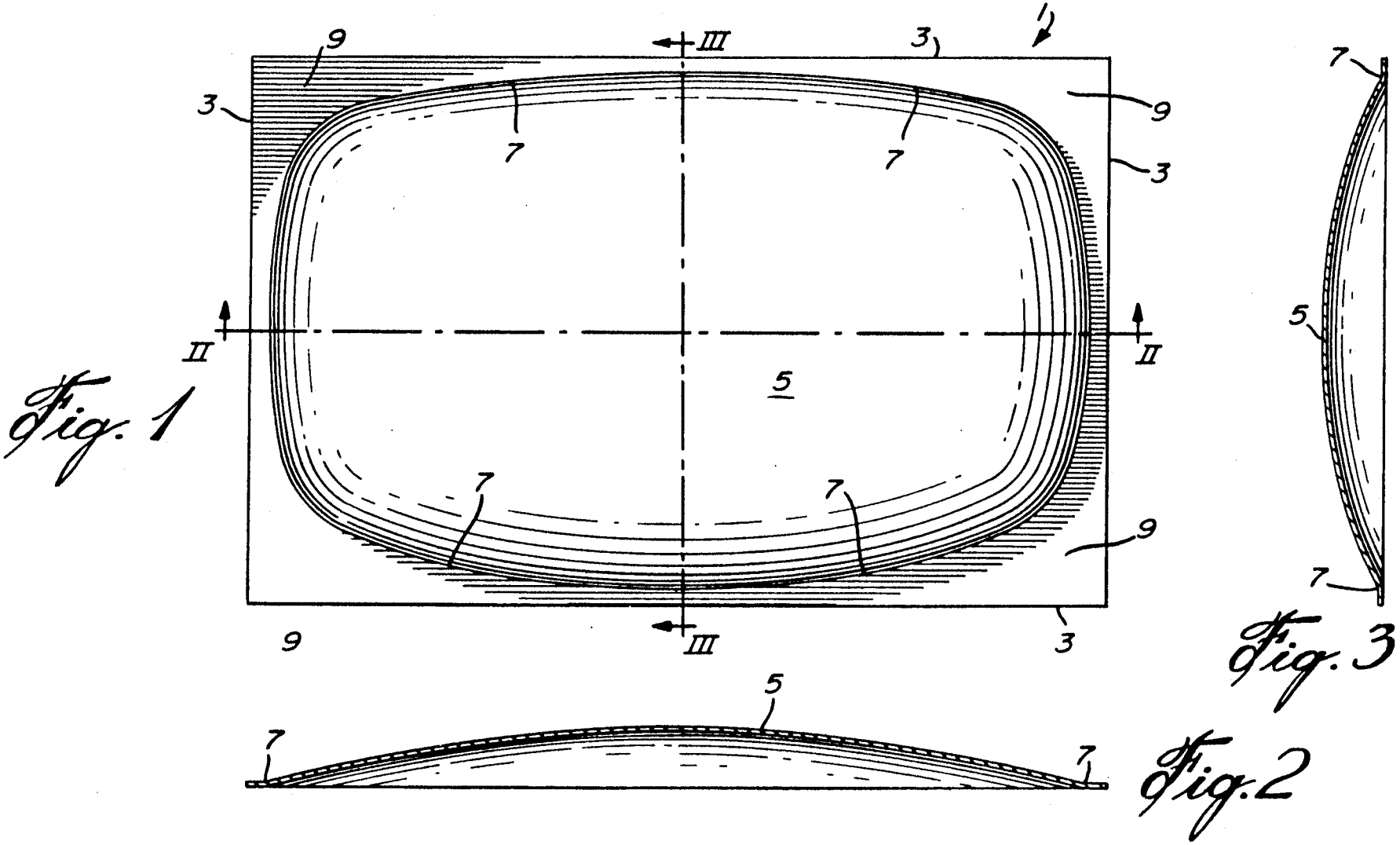
FIG. 1 is a top view of a metallic unit formed with an apparatus in accordance with the invention.
FIG. 2 is a section through II—II of FIG. 1.
FIG. 3 is a section through III—III of FIG. 1.

Referring now to FIGS. 1, 2 and 3, a workpiece 1, having an outer peripheral edge 3, has a metallic unit including a concave portion 5 bounded by an edge 7 of predetermined shape formed therein. The metallic unit can comprise, for example, a metal tank head.

As can be seen, after the concave portion is formed in the workpiece, portions 9 remain outside of the boundary of the concave portion. These portions 9 would be cut away so that the metallic unit would consist only of the concave portion bounded by the edge 7 of predetermined shape.

Figure 5:
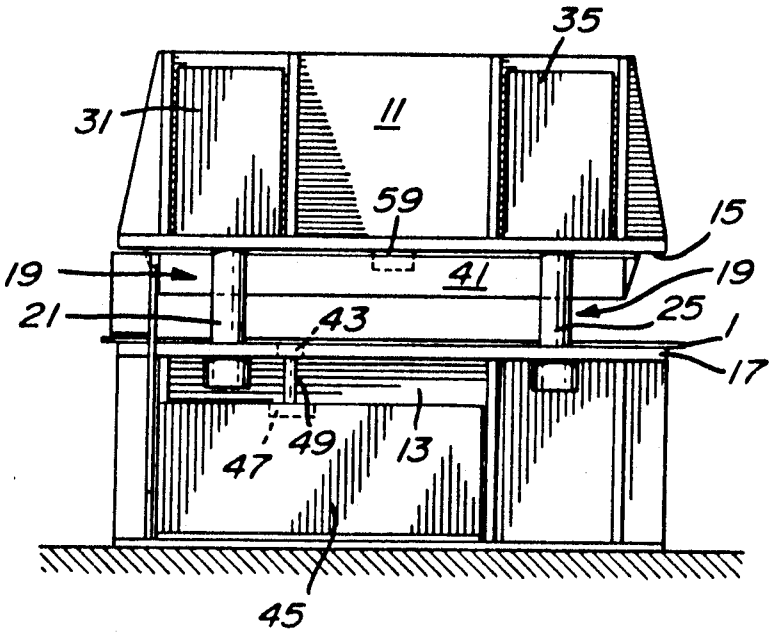
FIG. 5 is an end view of an apparatus in accordance with the invention.
Figure 4:
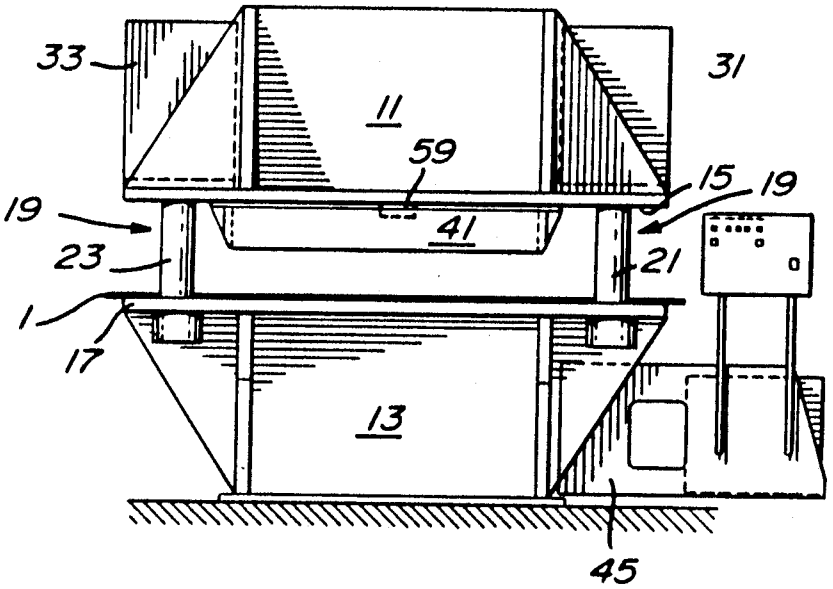
FIG. 4 is a side view of an apparatus in accordance with the invention.

Referring now to FIGS. 4 and 5, the apparatus for forming the metallic unit comprises an upper member 11 and a lower member 13. The upper member 11 includes a flat plate member 15, and the lower member includes a flat plate member 17. Means 19 are provided for moving one of the upper or lower members relative to the other one of the upper or lower members to thereby move the upper and lower members towards or away from each other. In the illustrated embodiment, the means 19 comprise four piston and cylinder arrangements, 21/31, 23/33, 25/35 and 27/37 (not shown). As can be seen, in the illustrated arrangement, the means for moving moves the upper member 11 towards and away from the lower member 13 which is in fixed position. Thus, the pistons 21, 23, 25 and 27 are affixed to the flat plate member 17 of the lower member 13. The cylinders 31, 33, 35 and 37 are affixed to the flat plate member 15 so that the upper member 11 will move upwardly and downwardly with the cylinders. Removably mounted on the lower surface of flat plate member 15 of the upper member 11 is a tool 41. The characteristics of the tool will be described when discussing FIGS. 6 and 7 below.

Included in the flat plate member 17 is an opening 43. Disposed adjacent to the lower member 13 is a means 45 for providing fluid, for example, air, under pressure. The means 45 includes an output 47, and a communicating means, for example, a hose 49 is connected between the output 47 and the opening 43.

Figure 7:
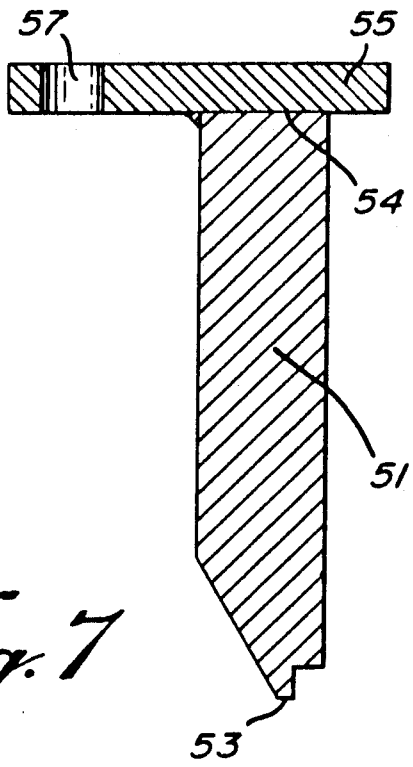
FIG. 7 is a section through VII—VII of FIG. 6.
Figure 6:
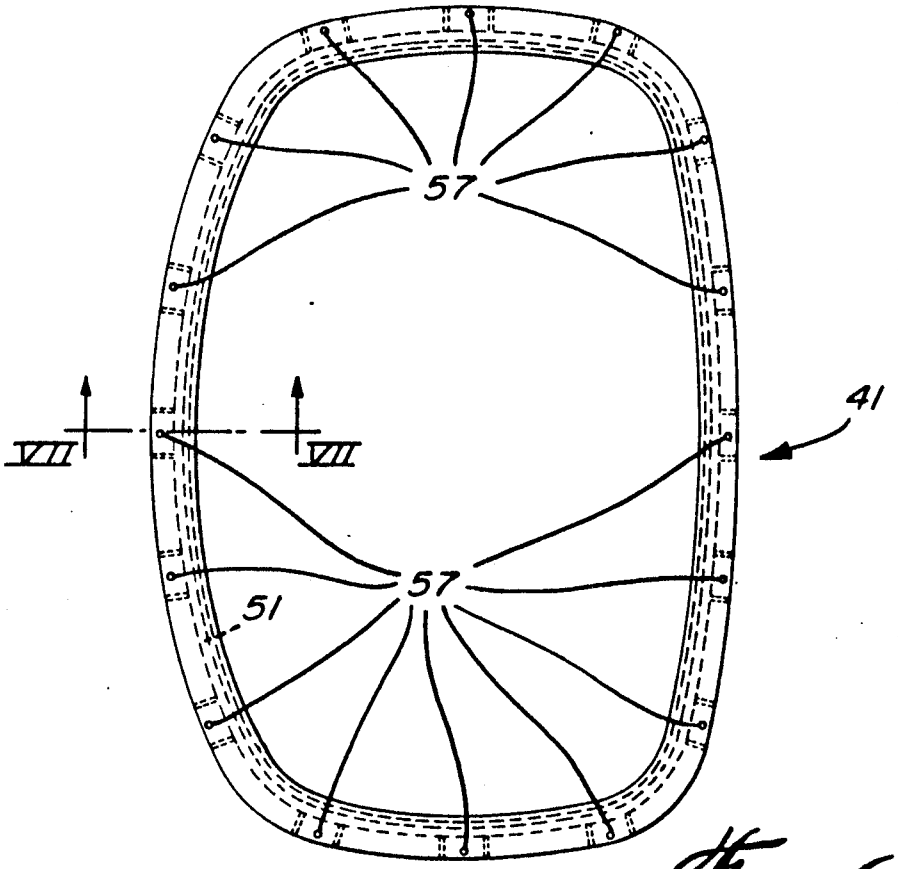
FIG. 6 is a top view of a tool mountable on the apparatus.

Turning now to FIGS. 6 and 7, the tool 41 comprises a wall-like arrangement 51 having a bottom edge 53 and a top edge 54. A platform 55 is mounted on the top edge and the platform includes a plurality of screw holes 57 whereby to mount the tool on the flat plate member 15 of the upper member. A sensor 59 is mounted on the lower surface of flat plate member 15 of the upper member 11 for reasons to be discussed below.

An electronic control unit 61 is provided to control the motion of the upper member 11 relative to the lower member 13, and also to control the means 45 for providing fluid under pressure.

In operation, a workpiece 1 is laid on the flat plate member 17 of the lower member 13 as shown in FIGS. 4 and 5. As can be seen, the outer peripheral edge of the workpiece completely surrounds the bottom edge of the tool 41.

The electronic unit 61 is then activated to move the upper member 11 towards the lower member 13 until the bottom edge 53 of the tool 41 abuts the upper surface of the workpiece 1 so that the tool and workpiece are clamped together in airtight engagement. Air under pressure is then fed to the opening 43 from means 45 through hose 49 under the lower surface of the workpiece 1. The workpiece is then forced upwardly by the pressure of the fluid to form the shape as illustrated in FIGS. 1, 2 and 3. When the top surface engages the sensor 59, the means 45 for providing fluid under pressure is turned off.

It can be seen that, with the inventive apparatus, no die is required for the forming of the metallic unit.

The concave metallic unit formed by the apparatus has a peripheral shape defined by the edge 7 in FIG. 1. The bottom edge 53 of the wall-like arrangement 51 defines a shape which is identical to the shape defined by the edge 7 of the formed concave metallic unit.

Although a particular embodiment has been described, this was for the purpose of illustrating, but not limiting, the invention. Various modifications, which will come readily to the mind of one skilled in the art, are within the scope of the invention as defined in the appended claims.

I claim:

1. Apparatus for forming, from a metallic workpiece, a metallic unit having a concave portion bounded by a peripheral edge, said peripheral edge having a predetermined shape;

said apparatus comprising:

an upper member and a lower member;

means for moving one of said upper or lower members relative to the other one of said upper or lower members to thereby move said upper and lower members toward or away from each other;

means for removably mounting a tool on one of said upper or lower members, the other one of said upper or lower members having an opening therein;

means for providing fluid under pressure, said means for providing having output means; and communication means connecting said output means to said opening;

wherein, said tool comprises a ring-shaped member having a continuously curved inner surface with a bottom open end and a top open end, said bottom end of said tool having a bottom edge defining a shape, said shape of said bottom edge corresponding with said predetermined shape;

whereby, in operation, said workpiece, having an outer peripheral edge, is disposed between said upper and lower member such that said outer peripheral edge surrounds said bottom edge, said upper and lower members are moved towards each other until said bottom edge abuts a surface of said workpiece so that the tool and workpiece are clamped together in airtight engagement, and said fluid under pressure is applied to said opening under the other surface of said workpiece;

whereby said fluid under pressure forces said workpiece in a direction away from said opening to thereby form said concave portion.

2. Apparatus as defined in claim 1 wherein said tool is removably mounted on said upper member: and said opening being in said lower member.

3. Apparatus as defined in claim 2 wherein said means communicating comprises hose means.

4. Apparatus as defined in any one of claims 1, 2 or 3 wherein said means for moving comprises a plurality of piston and cylinder arrangements;

said pistons of said piston and cylinder arrangements being affixed to said lower member;

said cylinders of said piston and cylinder arrangements being affixed to said upper member;

whereby, said upper member is movable toward or away from said lower member which is fixed.

5. Apparatus as defined in any one of claims 1, 2 or 3 wherein said lower member comprises a horizontal flat plate member and wherein said upper member comprises a parallel flat plate member;

and wherein said means for moving comprises a plurality of piston and cylinder arrangements;

said pistons of said piston and cylinder arrangements being affixed to the flat plate member of said lower member;

said cylinders of said piston and cylinder arrangements being affixed to the flat plate member of said upper member;

whereby, said upper member is movable toward or away from said lower member which is fixed.

* * * * *

UNITED STATES PATENT AND TRADEMARK OFFICE

CERTIFICATE OF CORRECTION

PATENT NO. : 5,076,085

DATED : 12/31/91

INVENTOR(S) : Rudy Fritsch

It is certified that error appears in the above-identified patent and that said Letters Patent is hereby corrected as shown below:

Col. 4, Row 39 Delete ":" and insert therefore --;--.

Signed and Sealed this

Sixth Day of July, 1993

*Attest:*

Michael K. Kirk

MICHAEL K. KIRK

*Attesting Officer*

*Acting Commissioner of Patents and Trademarks*